US006105203A

United States Patent [19]

Hueppi et al.

[11] Patent Number: 6,105,203

[45] Date of Patent: Aug. 22, 2000

[54] FLOOR CLEANING MACHINE

[75] Inventors: Karl Hueppi; Josef Waldispuehl; Dieter Windmeisser, all of Munchwilen, Switzerland

[73] Assignee: Diversey Lever, Inc., Plymouth, Mich.

[21] Appl. No.: 09/282,775

[22] Filed: Mar. 31, 1999

[30] Foreign Application Priority Data

Apr. 22, 1998 [EP] European Pat. Off. ..... 98201295

[51] Int. Cl.[7] ..... A47L 11/30

[52] U.S. Cl. ..... 15/320; 15/340.4

[58] Field of Search ..... 15/320, 340.3, 15/340.4, 364, 384, 401

[56] References Cited

U.S. PATENT DOCUMENTS

| | | | |
|---|---|---|---|
| 1,752,882 | 4/1930 | Boutwell | 15/320 |
| 2,731,659 | 12/1956 | Coplen | 15/320 |
| 3,996,640 | 12/1976 | Blue et al. | 15/320 |
| 4,429,432 | 2/1984 | Copeland et al. | 15/320 |
| 4,956,891 | 9/1990 | Wulff | 15/320 |
| 5,566,422 | 10/1996 | Geyer | 15/353 |
| 5,630,246 | 5/1997 | Knowlton et al. | 15/340.4 |

FOREIGN PATENT DOCUMENTS

| | | | |
|---|---|---|---|
| 017 519 | 10/1980 | European Pat. Off. . | |
| 42 08 094 | 9/1993 | Germany . | |
| 1729483 | 4/1992 | U.S.S.R. | 15/320 |
| 95/09557 | 4/1995 | WIPO . | |

OTHER PUBLICATIONS

European Search Report dated Sep. 15, 1998.

*Primary Examiner*—Robert J. Warden, Sr.
*Assistant Examiner*—Theresa T. Snider

[57] ABSTRACT

A floor cleaning machine for wet cleaning of a floor surface is provided, the machine having:

a frame (1);

at least one cleaning member (3), particularly a brush or pad, arranged rotatably on the frame;

a first conduit system (6) for feeding a first treatment solution to the floor surface in the region of the cleaning member for carrying out a first cleaning step;

a first suction unit (4) having a squeegee;

a second conduit system (9) for feeding a second treatment solution to the floor surface located behind the first suction unit as seen in the direction of normal forward movement of the machine, for carrying out a second cleaning step;

a second suction unit (5) having a squeegee;

tanks for fresh respectively used cleaning solution, whereby both suction units are connected to the used cleaning solution tank.

Such machines were found to provide good cleaning performance and favorable hygienic result.

8 Claims, 1 Drawing Sheet

FLOOR CLEANING MACHINE

FIELD OF THE INVENTION

The present invention relates to a floor cleaning machine for wet cleaning of a floor surface. In particular, the invention relates to such a machine, comprising means for carrying out at least two different floor treating steps.

BACKGROUND OF THE INVENTION

Floor treating machines suitable for wet cleaning of a floor surface, comprising means for two different treatments of the floor surface are known in the art.

For instance, WO-95/09557 (Zachhuber) discloses a multi-purpose floor treatment machine which can be used on badly contaminated floors, said machine being provided with a sweep-suction unit that can be combined with a scouring-suction unit.

Other types of mobile wet floor treatment machines comprising means for two different floor treatment steps are disclosed by DE-4208094 (A. Kaercher GmbH) and U.S. Pat. No. 2,731,659.

DE-4208094 relates to a floor cleaning machine having two brush rollers rotating in the same direction. A coarse dirt collecting container (15) is provided between the two scrubbing rollers and acts as a filter to hold back the dirt particles and to allow the cleaning fluid to pass for the second roller. At the end of the machine there is provided a suction device for sucking up the used liquid. U.S. Pat. No. 2,731,659 refers to a floor scrubbing machine with which the floor surface can be subjected first to a scrubbing action with cleaning solution by a first brush followed by a rinsing scrubbing action by a second brush with clean water. The soiled cleaning solution is continuously removed by a first suction head and the soiled rinse water is continuously removed by a second suction head.

However, as can be seen in the prior art documents, the mechanical construction of the known machines comprising means for carrying out two different floor treating steps, is generally rather complicated. For instance, DE-4208094 provides a floor cleaning machine having a special mechanical system including rather specifically designed brushes for removing coarse dirt particles. Furthermore, the known machines do not allow the operator thereof to change the type of cleaning solution, during operation, nor do they have tanks for different types of cleaning solution.

Moreover, floor cleaning machines with which used cleaning solution can be recycled, are not known in the art.

It is an object of the present invention to provide a versatile and reliable floor cleaning machine for wet cleaning of a floor surface, said machine having a relatively simple construction.

It is another object to provide a floor cleaning machine for wet cleaning, having improved cleaning performance and giving a better hygienic result as compared to known floor cleaning machines of the prior art.

It is a further object to provide a machine with which coarse dirt particles can be effectively removed using relatively low amounts of energy, whereby said machine does not include a special mechanical system for removal of such particles.

It is a still further object to provide a machine with which the economy of use of cleaning and disinfecting solutions carried by the machine, is improved.

It has now surprisingly been found that these and other objects can be achieved by the floor cleaning machine of the present invention.

SUMMARY OF THE INVENTION

The present invention provides a floor cleaning machine for wet cleaning of a floor surface, comprising:

- a frame;
- at least one cleaning member arranged rotatably on the frame;
- a first conduit system for feeding a first treatment solution to the floor surface in the region of the cleaning member, for carrying out a first cleaning step;
- a first suction unit comprising a squeegee;
- a second conduit system for feeding a second treatment solution to the floor surface located behind the first suction unit as seen in the direction of the normal forward movement of the machine, for carrying out a second cleaning step;
- a second suction unit comprising a squeegee;
- a tank for fresh cleaning solution;
- a tank for used cleaning solution;

wherein both suction units are connected to the used cleaning solution tank.

The floor cleaning machine of the present invention comprises two conduit systems for feeding a first respectively a second treatment solution to the floor surface to be cleaned, as well as two suction units. These suction units are desirably equipped with oblong squeegees in order to effectively collect the used cleaning solution.

Furthermore, the floor cleaning machine of the present invention includes a tank for fresh cleaning solution and a tank for used cleaning solution.

Using this configuration, good floor cleaning performance could be obtained.

The floor cleaning machine of the invention may be either an operator-driven machine or a motor-driven (so-called "ride-on") machine.

The first conduit system present in the machine of the invention desirably comprises conduits extending into both the fresh cleaning solution tank and the used cleaning solution tank such that the treatment solution for use in the first cleaning step can be selected from the fresh cleaning solution and the used solution. As a consequence, the operator can recycle cleaning solution by selecting used cleaning solution. Thus, a highly efficient cleaning performance can be achieved, if used cleaning solution is applied in the first cleaning step and fresh cleaning solution is applied in the second cleaning step. Even in high risk areas, such as hospitals, nursing homes and other health care institutions the floor cleaning machine of the invention may be operated in this way without running the risk of cross-contamination since fresh cleaning solution is applied in the second cleaning step. In conventional machines of the prior art, this risk of cross-contamination exists since the cleaning members and solution in contact with the floor can become contaminated with micro-organisms which were picked up together with soil from previously treated floor surfaces. The present invention allows the use of uncontaminated fresh cleaning solution (which may be fresh rinse water) or disinfecting solution in a second cleaning step so as to diminish or even eliminate the risk that this undesirable effect would occur.

The cleaning member present in the machine of the invention may be a brush or a pad. Brushes which are rotatable on a vertical axis are preferably used as cleaning members. For obtaining good cleaning performance, the machine of the invention preferably comprises two brushes. When a suction unit containing an oblong squeegee is applied, coarse dirt particles which may be present on the floor surface to be cleaned, may form a blockage in the squeegee when being removed.

To overcome this problem, the two brushes are desirably situated such that they can effectively cooperate to collect the coarse dirt particles and direct these particles toward the middle of the first suction unit which is located immediately behind the brushes. When using such a configuration, the coarse dirt particles can be simply removed by sucking them together with the used first cleaning solution and transferring them into the used solution tank. The risk that blockage of the squeegee occurs is thereby reduced.

To further minimize the risk of squeegee blockage due to coarse dirt particles, it is preferred to apply a first suction unit having a specially designed squeegee such that coarse dirt particles can only reach the squeegee in the region of the center thereof near the connection with the suction line connecting the first suction unit with the used solution tank.

For obtaining a further improvement of the overall cleaning result, the second conduit system for feeding the second cleaning solution to the floor surface, is preferably equipped with one or more spray bars. Thus a thorough second treatment of the precleaned floor surface can be carried out.

It may well be desirable to further increase the number of modes of operation of the machine of the invention. In order to achieve that, not only the first conduit system but also the second conduit system desirably comprises conduits extending into both the fresh cleaning solution tank and the used solution tank such that the treatment solution for use in the second cleaning step can be selected from the fresh cleaning solution and the used solution. Thus, the operator has the possibility to recycle cleaning solution for the second cleaning step. In order to still further increase the versatility of the machine of the invention, it preferably comprises an additional tank for a second fresh cleaning or disinfecting solution for use in the second cleaning step. To that end, the second conduit system desirably includes conduits extending not only into the fresh cleaning solution tank and the used solution tank but also into this second fresh cleaning solution tank. When using this configuration, the treatment solution for use in the second cleaning step can be selected from both types of fresh cleaning solution and the used solution.

Particularly good hygienic results were observed when applying a disinfectant solution as the second fresh cleaning solution.

DETAILED DESCRIPTION OF THE INVENTION

Figure 1:
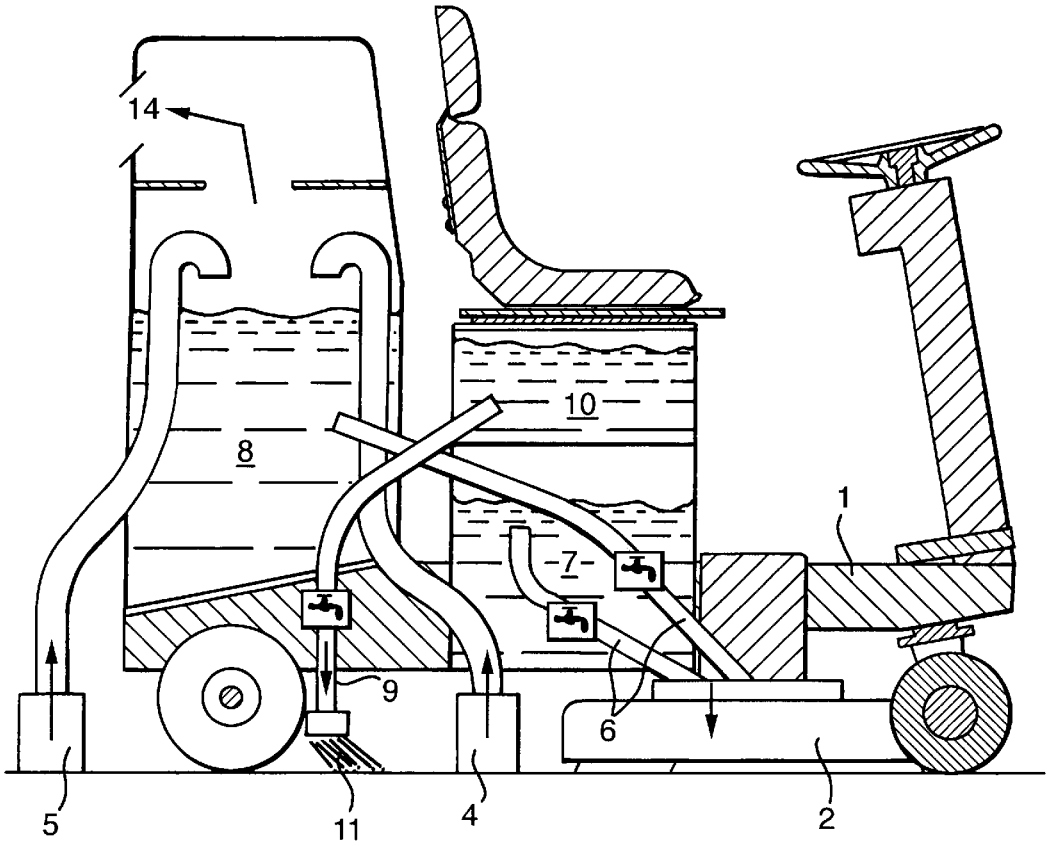
FIG. 1 shows a schematic cross-sectional side view of a preferred embodiment of the invention.

Referring now in detail to these drawings, in FIG. 1 (1) indicates the frame of a preferred floor cleaning machine according to the invention, comprising a cleaning unit (2) having two brushes (3), a first suction unit (4) and a second suction unit (5).

FIG. 1 further shows a first conduit system (6) for feeding either fresh cleaning solution (7) or used cleaning solution (8) onto the floor surface near the brushes (3). FIG. 1 also shows a second conduit system (9) for feeding a second fresh cleaning solution (10) onto the floor surface by way of two spray bars (11).

In addition, FIG. 1 shows tanks for the first and second fresh cleaning solution as well as the used cleaning solution. Furthermore, the arrow (14) indicates that the tank for the used cleaning solution (8) is kept at underpressure by the action of a vacuum motor (not shown).

Figure 2:
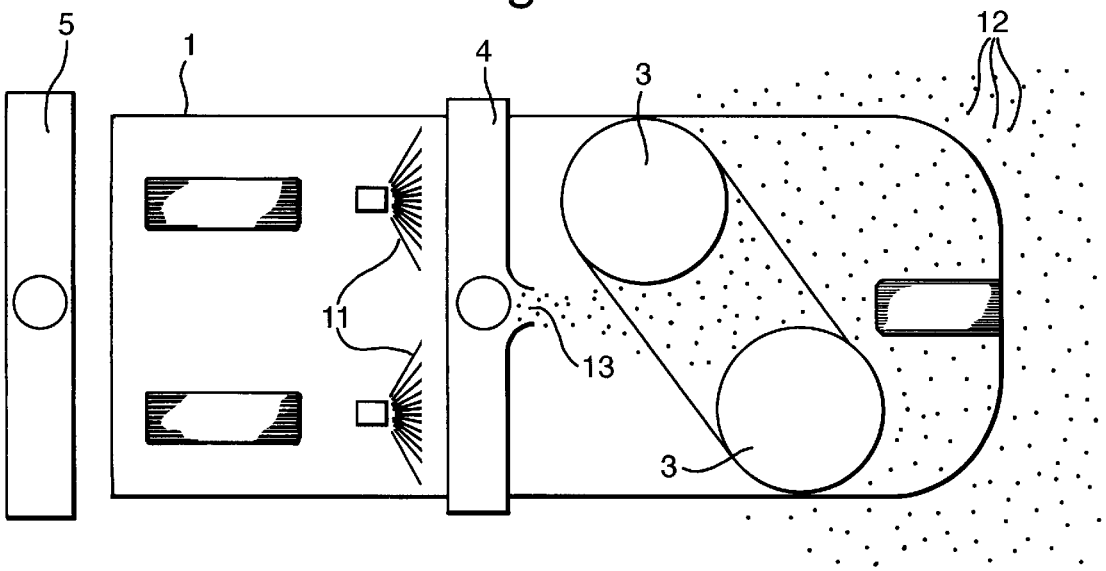
FIG. 2 shows a schematic cross-sectional top-view of said preferred embodiment.

In FIG. 2, the configuration of the two rotatable brushes (3) is shown, whereby their direction of movement is indicated. Owing to the combined action of both brushes, the coarse dirt particles (12) are directed towards a coarse dirt particle inlet (13) of a rather specially designed first suction unit (4).

It is emphasized that the floor cleaning machine shown in the Figures illustrates only a preferred embodiment of the invention and that various constructional alternatives will be immediately evident to the person skilled in the art, without departing from the scope of the present invention.

What is claimed is:

1. Floor cleaning machine for wet cleaning of a floor surface, comprising:

a frame (1);

at least one cleaning member (3) arranged rotatably on the frame;

a first conduit system (6) for feeding a first treatment solution to the floor surface in the region of the cleaning member for carrying out a first cleaning step;

a first suction unit (4);

a second conduit system (9) for feeding a second treatment solution to the floor surface located behind the first suction unit as seen in the direction of normal forward movement of the machine, for carrying out a second cleaning step;

a second suction unit (5);

a tank for fresh cleaning solution (7);

a tank for used cleaning solution (8), whereby both suction units are connected to the used cleaning solution tank, wherein the first conduit system (6) comprises conduits extending into both the tank for fresh cleaning solution and the tank for used cleaning solution, such that a cleaning solution for use in the first cleaning step can be selected from the fresh cleaning solution (7) and the used cleaning solution (8).

2. Machine according to claim 1, wherein at least one cleaning member (3) comprises two component cleaning members (3).

3. Machine according to claim 2, wherein the two component cleaning members are brushes.

4. Machine according to claim 1, wherein the second conduit system has a spray bar (11) for releasing a second cleaning solution onto the floor surface.

5. Machine according to claim 1, wherein the second conduit system (9) comprises conduits extending into the fresh cleaning solution tank and the used cleaning solution tank, such that the treatment solution for use in the second cleaning step can be selected from the fresh cleaning solution and the used cleaning solution.

6. Machine according to claim 1, wherein the machine comprises an additional tank for a second fresh cleaning solution (10) and wherein the second conduit system (9) comprises conduits extending into the fresh cleaning solution tank, the second fresh cleaning solution tank and the used solution tank, such that the treatment solution for use in the second cleaning step can be selected from the fresh cleaning solution (7), the second fresh cleaning solution (10) and the used solution (8).

7. Machine according to claim 6, wherein the second fresh cleaning solution (10) is a disinfecting solution.

8. Machine according to claim 1, wherein the at least one cleaning member consists of two brushes (3) and wherein the first suction unit (4) has an oblong shape and a centrally-located, relatively narrow opening for fluid to be sucked up such that course dirt particles can be sucked up from the floor surface without the risk of blocking the suction unit.

* * * * *